United States Patent [19]

Brede et al.

[11] Patent Number: 4,938,139

[45] Date of Patent: Jul. 3, 1990

[54] AFTER-FIRING SAFETY DEVICE IN A PROJECTILE WITH PERCUSSION FUZE

[75] Inventors: Uwe Brede; Ernst Jensen; Helmuth Werner, all of Furth, Fed. Rep. of Germany

[73] Assignee: Dynamit Nobel Aktiengesellschaft, Troisdorf, Fed. Rep. of Germany

[21] Appl. No.: 363,282

[22] Filed: Jun. 6, 1989

Related U.S. Application Data

[63] Continuation of Ser. No. 273,573, Nov. 21, 1988, abandoned.

[30] Foreign Application Priority Data

Nov. 20, 1987 [DE] Fed. Rep. of Germany ..... 3739368

[51] Int. Cl.[5] ..... F42C 15/04; F42C 15/20

[52] U.S. Cl. ..... 102/249; 102/233; 102/240; 102/257

[58] Field of Search ..... 102/240, 251, 249, 233, 102/252, 255, 257, 243

[56] References Cited

U.S. PATENT DOCUMENTS

| | | | |
|---|---|---|---|
| 3,030,886 | 4/1962 | Junghaus et al. | 102/240 |
| 3,249,051 | 5/1966 | Kaiser | 102/240 |
| 4,026,216 | 5/1977 | Backstein | 102/244 |
| 4,458,594 | 7/1984 | Weber et al. | 102/240 |
| 4,510,869 | 4/1985 | Nicolas et al. | 102/240 |
| 4,662,279 | 5/1987 | Popovitch | 102/233 |

FOREIGN PATENT DOCUMENTS

| | | | |
|---|---|---|---|
| 27061 | 1/1921 | Denmark | 102/240 |
| 2457947 | 6/1976 | Fed. Rep. of Germany . | |
| 3151470 | 7/1983 | Fed. Rep. of Germany . | |
| 1198830 | 12/1959 | France . | |
| 77692 | 2/1962 | France . | |
| 2533686 | 3/1984 | France . | |

*Primary Examiner*—David H. Brown

*Attorney, Agent, or Firm*—Antonelli, Terry, Stout & Kraus

[57] ABSTRACT

An after-firing safety device in a projectile with percussion fuze includes a spiral spring set having at least three springs wound up in series with respectively opposite directions. The spring set, maintained under tension by a cage, starts to uncoil as soon as the cage slides off the spiral spring set on account of the acceleration of the projectile during firing. The time elapsing until a central aperture has been entirely vacated depends on the number of springs, the spring lengh, the spring tension, and the friction characteristic. The after-firing safety device is equally well suited for spinning projectiles as well as nonspinning projectiles.

8 Claims, 2 Drawing Sheets

AFTER-FIRING SAFETY DEVICE IN A PROJECTILE WITH PERCUSSION FUZE

This application is a continuation of application Ser. No. 273,573, filed Nov. 21, 1988, now abandoned.

The invention relates to an after-firing or post-barrel safety device in a projectile equipped with a percussion fuze, the device having a tensioned spiral spring assembly surrounded by a cage, this assembly occupying a space between a detonator or detonator member and a primer needle to such a degree that contacting of the detonator by the primer needle is precluded; the spiral spring assembly is afforded the possibility of relaxing only after firing of the projectile, due to a displacement of the cage, the space occupied by the spring becoming vacant and thereby enabling the detonator to move.

DOS No. 3,501,450 describes an after-firing safety mechanism for training ammunition wherein the detonator is held by a locking pin in such a position that the igniter pin cannot contact the detonator and thus initiation of the effective charge does not occur in this condition. The locking pin is ejected, after firing of the ammunition, with a delay by gas pressure; for this purpose, a pyrotechnical gas generator is required which is initiated during firing of the ammunition by way of an igniter system with a propagation section operating with a delay. This mechanism is relatively expensive in its manufacture.

In another after-firing safety device in connection with a percussion fuze for a spinning projectile (DOS No. 2,735,575), a central bore is initially sealed by a blocking disk whereby a primer needle is prevented from contacting a percussion pin or igniting a pyrotechnical deflagration section. This central bore is opened up by the provision of a coiled strip that unwinds under the effect of centrifugal force, and a rotation of the clamping disk in opposition to the rotation direction of the projectile leads to a deflection of the locking disk from the zone of the central bore. The coiled strip is coaxially housed in an annular cage, the inner bore of which constitutes the central bore, and the annular chamber of which is dimensioned so that it accommodates the blocking disk, with the coiled strip unwound, with partial or complete vacating of the central bore.

Such a device does not always result in an adequate vacating of the central bore; besides, activation takes place too rapidly and too inaccurately.

The invention has the object of providing a precise, simple safety device at the percussion fuze of projectiles which acts safely over an adjustable, even relatively long period of time.

This object has been attained by an after-firing safety device wherein a spiral spring assembly or set having several spiral springs, wound up in series with respectively opposite directions, is inserted in a cage.

The wound-up spring set serves the purpose of preventing, by its presence in an interspace, an approach of a detonator needle against a detonator. There is no need for additional spacers or a blocking disk. Once the cage, during firing, slides off from the spiral spring set on account of its inertia, the outermost layer of the external spiral spring immediately begins to relax. Relaxing of the spiral spring proceeds consecutively from the outside toward the inside, never distributed simultaneously over the entire spring length. According to the invention, several spiral springs are to be wound one on top of the other; the sense of winding direction is to change with each spring Thereby, there occurs in each case a slowing down and a reversal of the rotation of the spring set when changing from one spring to another; the uncoiling of the subsequent, oppositely oriented spring thus begins in each case again at zero. As a consequence, with only three oppositely wound springs, it is already possible to produce considerable delay times in a safe and reproducible fashion. The spiral springs are dimensioned so that, after relaxing, the internal diameter has become so large that the detonator pin can be shifted unhindered in a direction toward the ignition needle. The time during which ignition must not take place can be set very precisely with simple means by the parameters of spring length, spring bias, degree of tensioning dependent on the diameter of the cage and the pretreatment of the spring, as well as on the mutual friction of the spring strip layers. A special advantage of this safety mechanism resides in that activation of the mechanism is independent of a spinning motion of the projectile. The safety feature and, respectively, the activating feature are brought about in the same way, independently of whether or not the projectile rotates about its longitudinal axis. Prefered however is the device for a non spinning projectile.

In the after-firing safety device of this invention, a conventional safety feature during transport can also be realized in a maximally simple way, by fixing the cage in the axial direction by means of a lateral securing pin.

If a disk-shaped permanent magnet with magnetization substantially in the plane of the disk is arranged above and/or below the spiral spring set, then the rotation of the spring set is decelerated during relaxing. In this way, the safety time span can be lengthened.

The invention is illustrated in the accompanying drawings and will be described in greater detail hereinafter by way of specific embodiments.

Figure 1:
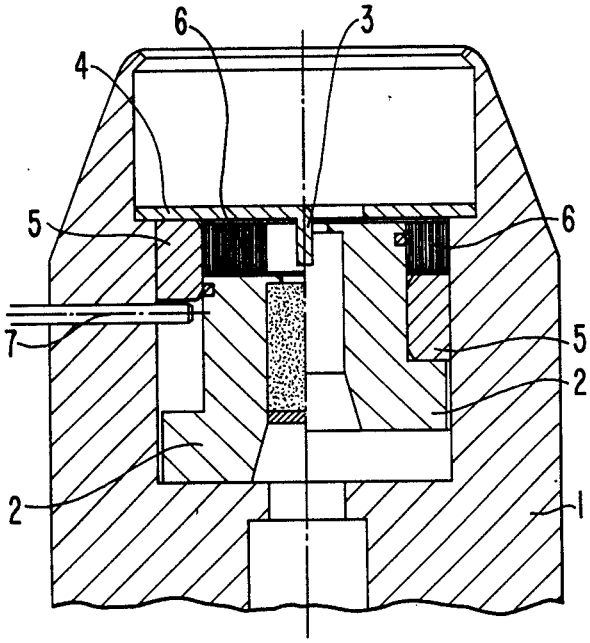
FIG. 1 is a section taken through the head of the projectile.

FIG. 1 shows a head 1 of a projectile with the after-firing safety device of this invention. The left-hand half of the figure illustrates the safety position; in the right-hand half, the after-firing safety mechanism has been deactivated or shut off, and the axially movable detonator 2, on account of its inertia, has, upon hitting the primer needle 3, impinged upon the primer needle disk 4.

In the safety position, the spiral spring set 6 encompassed by a cage 5 having the form of a circular ring extends into the space between the primer needle 3 and the front face of the detonator 2 to such a degree that even in case of maximum accelerations any contact of the primer needle 3 against the detonator 2 is precluded on account of the stiffness of the spring set 6. In the left-hand partial illustration, a locking pin 7 can furthermore be seen, serving as safety means during transport of the projectile. As long as this pin 7 has not been pulled out, the cage 5 cannot move and thus ignition is impossible. Prior to loading, the pin 7 is removed.

During firing, the cage 5 will slide, on account of the acceleration of the projectile, rearwardly over the detonator pin 2. As soon as the spring set is no longer surrounded by the cage 5, relaxing of the wound-up spring set 6 will begin.

Figure 2:
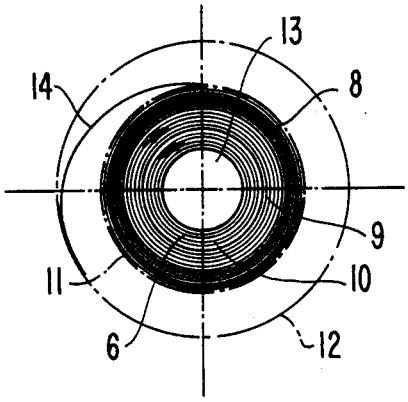
FIG. 2 is a top view of a spring set.

FIG. 2 shows the spring set 6, wound up of three individual springs 8, 9, 10, more clearly. The inner dot-dash line 11 indicates the internal diameter of the cage 5 and corresponds approximately to the outer diameter of the detonator 2. The outer dot-dash line 12 indicates the external diameter of the cage 5 and, respectively, the inner wall of the projectile head, and characterizes the space maximally available for expansion of the spring set 6. The space is of such a size that, in the relaxed condition of the spring set 6, the inner, approximately circular space 13 defined by the spring set has become so large that the forward part of the detonator 2 can pass through.

FIG. 2 shows the condition wherein the cage 5 has just slipped onto the rear portion of the detonator and relaxing of the spring set 6 is starting. The tip 14 of the spring 8 contacts outwardly the inner wall 12 of the projectile and the remainder of the spring set 6 tends to rotationally uncoil along the wall 12 of the newly generated, larger vacant space. The spring set 6 turns at increasing speed of revolution but with the inner coil core still being closed, up to the end of the spring strip 8.

The springs 9, 10, still tightly coiled at this point in time, rotate at such a high speed that initially no unwinding of the middle 9 and inner 10 spring band is possible because the middle spring strip 9 must first change the direction of rotation in order to unwind. Only after the rotation of the spring set 6 has come to a standstill ca the top layer of the middle spring detach itself from the still solid remainder of the spring set. Thereafter follows the unwinding of the middle spring 9, in that the spring, as in the case of the external spring or coil strip 8, contacts the relaxed spring 8 toward the outside and begins rotating in the opposite direction. The innermost spring 10 remains tightly tensioned until the spring set has once more come to a standstill, and the spring tip of the spring 10 begins to relax and rotate while in contact with the expanded spring 9.

At the end of the expansion process, the end of spring 10 is in quite close contact on the inside against the annular spring set, having an enlarged diameter, and the central opening 13 is of such a size that even the spring 10 can no longer impede the axial movement of the detonator 2.

The time elapsing until the tensioned spring set 6 has expanded into a larger, again annular spring set depends on various values and can be very readily adjusted. Of importance are the length, the tension, and the mutual friction of the strip layers. Relaxing and thus also rotation of the spring set can be braked advantageously by magnetic means, resulting in a lengthening of the safety period.

Figure 3:
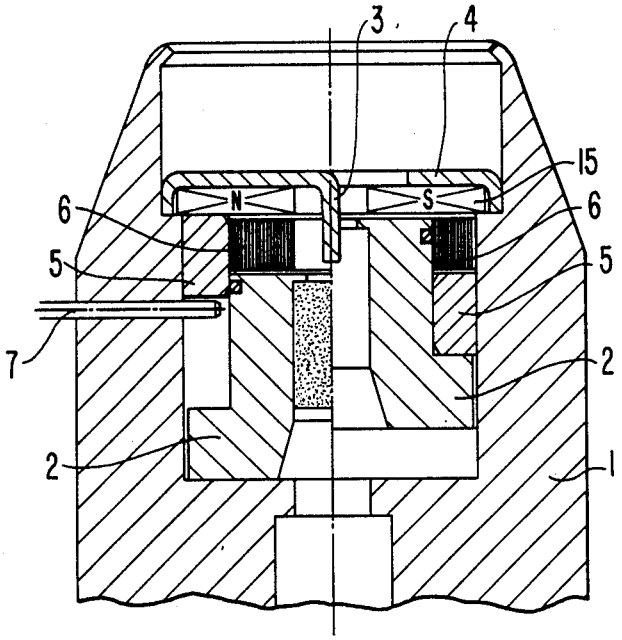
FIG. 3 shows a section of the head of the projectile with a magnetic brake.

A safety device with a magnetic brake is shown in FIG. 3. The left-hand half shows the safety condition, as in FIG. 1 and the right-hand half shows the condition upon impact: the primer needle 3 has penetrated, during braking, into the forwardly moved detonator 2. The parts are denoted by the same reference numerals as in FIG. 1.

The primer needle disk 4 in this embodiment is bent somewhat in the upward direction, receiving an annular disk 15 of a permanent magnet. This disk is magnetized in such a way that the magnetization direction extends substantially in the annular plane and the two poles are formed on the disk in mutual opposition, and the lines of flux extend predominantly perpendicularly to the spiral springs of the spring set 6 in order to decelerate the rotation of the spring set.

Figure 4:
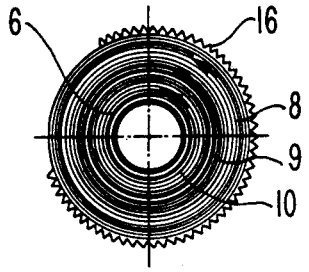
FIG. 4 shows a spring set with the outermost spring having a corrugated end.

FIG. 4 shows a somewhat modified spring set 6. The beginning 16 of the outermost spiral spring 8 is corrugated in this example. This prevents the outermost winding of the spiral spring from slipping between the cage and the detonator pin during the process of withdrawal of the cage from the spiral spring set.

What is claimed is:

1. An after-firing safety device in a nonspinning projectile having a percussion fuze said device comprising a tension spiral spring set surrounded by a cage, said spring set occupying a space formed between a detonator and a primer needle to such an extent that contacting of the detonator by the primer needle is precluded, and the spiral spring set is afforded the possibility of relaxing only after firing of the projectile by displacement of the cage due to acceleration of the projectile, said space becoming available and thereby making movement of the detonator possible, said spiral spring set comprising several spiral springs wound up in series in respectively opposite directions and being inserted within the cage.

2. The after-firing safety device according to claim 1, wherein a magnetized plate is provided above the spiral spring set.

3. The after-firing safety device according to claim 1, wherein the spiral spring set consists of three spiral springs.

4. The after-firing safety device according to claim 3, wherein a magnetized plate is provided above the spiral spring set.

5. An after-firing safety device in a non-spinning projectile with a percussion fuze, said device comprising a multipartite coiled strip pack wherein individual windings are in each case wound up in opposite directions, said pack in a safety condition retaining two mutually movable parts of a fuze train at a spacing from each other and also releasing the movement thereof in an armed condition, said windings comprising a spiral spring set and being surrounded in the safety condition by a cage that can be displaced due to acceleration of the projectile upon firing of the projectile wherein after release of the spiral spring set by the cage, an unwinding process takes place in such a way that initially the an outermost spiral spring of the spring set is relaxed progressively from the outside towards the inside and during this step, the remaining springs of the spring sets are set into rotation and that there occurs upon transition to the spiral spring, being arranged next in the outerward direction, of the remaining springs in the spring set and its relaxation, a standstill and a subsequent reversal of the rotation of the respective remaining springs of the spring set.

6. An after-firing safety device according to claim 5, wherein the spiral spring set consists of three spiral springs.

7. An after-firing safety device according to claim 5, wherein a magnetized plate is provided above the spiral spring set.

8. An after-firing safety device according to claim 5, wherein a magnetized plate is provided below the spiral spring set.

* * * * *